US012636546B2

(12) United States Patent
Torok et al.

(10) Patent No.: US 12,636,546 B2
(45) Date of Patent: May 26, 2026

(54) PERTURBATION DEVICE FOR PROPIOCEPTION AND VESTIBULAR TRAINING

(71) Applicant: Kinesia, Inc., Wakefield, RI (US)

(72) Inventors: Mark Torok, Wakefield, RI (US); Christopher J. O'Brien, Wakefield, RI (US)

(73) Assignee: Kinesia, Inc., Wakefield, RI (US)

( * ) Notice: Subject to any disclaimer, the term of this patent is extended or adjusted under 35 U.S.C. 154(b) by 170 days.

(21) Appl. No.: 18/669,798

(22) Filed: May 21, 2024

(65) Prior Publication Data

US 2024/0390730 A1 Nov. 28, 2024

Related U.S. Application Data

(60) Provisional application No. 63/503,881, filed on May 23, 2023.

(51) Int. Cl.
*A63B 22/16* (2006.01)

(52) U.S. Cl.
CPC ..... *A63B 22/16* (2013.01)

(58) Field of Classification Search
CPC ..... A63B 22/16; A63B 22/18; A61H 1/005
See application file for complete search history.

(56) References Cited

U.S. PATENT DOCUMENTS

| | | | | |
|---|---|---|---|---|
| 3,890,722 | A | 6/1975 | Nunez | |
| 5,209,240 | A | 5/1993 | Jain et al. | |
| 6,561,991 | B2 | 5/2003 | McLeod et al. | |
| 7,374,522 | B2 | 5/2008 | Arnold | |
| 8,057,366 | B2 * | 11/2011 | Schippers | A61H 1/003 482/110 |
| 8,246,354 | B2 | 8/2012 | Chu et al. | |
| 8,435,164 | B2 | 5/2013 | VanBuren | |
| 8,529,418 | B2 | 9/2013 | Stewart et al. | |
| 8,827,882 | B2 * | 9/2014 | Rogers | A63B 21/4033 482/146 |
| 8,986,180 | B1 | 3/2015 | VanBuren et al. | |
| 10,434,371 | B2 | 10/2019 | Shoffler | |
| 12,403,592 | B1 * | 9/2025 | Berme | B25J 9/1623 |

(Continued)

FOREIGN PATENT DOCUMENTS

| | | | | |
|---|---|---|---|---|
| CN | 115054873 A | * 9/2022 | | A61H 1/005 |
| CN | 116920332 A | * 10/2023 | | A63B 22/16 |

(Continued)

*Primary Examiner* — Joshua T Kennedy
(74) *Attorney, Agent, or Firm* — Hinckley Allen & Snyder; Stephen Holmes

(57) ABSTRACT

A portable two-axis perturbation device includes two separated X-Y plane motion platforms controlled by respective motor pairs that may be independently controlled with respect to frequency, amplitude, and variation of movement patterns to create "bottom-up" unpredictable movement patterns more closely resembling real world environmental interactions. By reproducing the amplitude, frequency, direction and variability of external stimuli that may disrupt human balance, the device provides a novel way to train, rehabilitate, reproduce, manipulate and ultimately improve reactive balance reflexes, proprioception and kinesthetic awareness in a way that "top down" perturbation cannot.

17 Claims, 4 Drawing Sheets

(56) References Cited

U.S. PATENT DOCUMENTS

| | | | | |
|---|---|---|---|---|
| 12,434,105 | B1 * | 10/2025 | Gressick | A63B 24/0087 |
| 2002/0045955 | A1 * | 4/2002 | Borta | G09B 9/12 700/28 |
| 2006/0229159 | A1 * | 10/2006 | Nagata | A63B 26/003 482/92 |
| 2007/0184953 | A1 | 8/2007 | Luberski et al. | |
| 2010/0145233 | A1 * | 6/2010 | Zhang | A63B 22/0056 600/595 |
| 2010/0273619 | A1 * | 10/2010 | Ozawa | A63B 23/08 482/146 |
| 2011/0118630 | A1 * | 5/2011 | Kobayashi | A61B 5/1121 600/592 |
| 2015/0257965 | A1 * | 9/2015 | Simeone | A63B 26/003 482/146 |
| 2018/0015322 | A1 * | 1/2018 | Carr | A63B 22/203 |
| 2025/0229125 | A1 * | 7/2025 | Telesmanic | A63B 21/0552 |

FOREIGN PATENT DOCUMENTS

| | | | | |
|---|---|---|---|---|
| KR | 20110125296 A | * | 11/2011 | A63B 22/16 |
| WO | WO-2011105411 A1 | * | 9/2011 | A63B 22/0056 |

* cited by examiner

PERTURBATION DEVICE FOR PROPIOCEPTION AND VESTIBULAR TRAINING

CROSS-REFERENCE TO RELATED APPLICATIONS

This application is a non-provisional filing of, and claims the benefit of U.S. Provisional Patent Application No. 63/503,881, filed May 23, 2023, the entire contents of which is incorporated herein by reference.

BACKGROUND OF THE DISCLOSURE (1) Field of the Invention: The present disclosure generally relates to physical rehabilitation, proprioception, sports performance, vestibular and balance training, neuromuscular training and general physical fitness.

(2) Description of Related Art: Human balance is typically the result of reflexive reactions to external and internal stimuli from the environment. Proprioceptors and other specialized cells in the human body send signals to the spinal cord and brain regarding body position, velocity, pressure and other pertinent information that the brain synthesizes to make appropriate corrections based on this information. This feedback loop is important when humans lose their balance through a slip, contact with external objects, muscle weakness, poor motor control, running, jumping, etc. To our knowledge, no known device can deliver an appropriate realistic input to a human subject from the "ground up" and elicit the intended reflexive balance response required to properly rehabilitate or improve balance.

Prior art perturbation devices for propioception training have been known in the field. These devices include wobble boards and rocker boards as well as other movable platform type devices. However, the prior art devices typically comprise a single movable balancing platform on which the user stands with both feet. These single platform devices lack any ability to create or induce movement separately under each foot or extremity.

Furthermore, most rehabilitation protocols developed for the purpose of improving human balance, proprioception and vestibular efficiencies are predictable, outdated and involve introducing external stimuli from above the ankle in weightbearing. This "top-down" method, while appropriate in an outpatient setting, does not realistically reproduce the environment, vector, randomness, or forces on the human body required to elicit a true reactive, reflexive correction that occurs during a true "bottom up" external force.

Examples of existing devices include U.S. Pat. Nos. 8,435,164 and 8,986,180 to VanBuren which each discloses a perturbation apparatus that provide complex motion combined with unexpected manual movements. The apparatus generally comprise a portable, manually manipulated perturbation board on which the user stands. The devices include a generally stationary base, a movable assembly within the base on which the user stands, and a manually manipulated assembly connected to the movable assembly and employed by a person other than the user to effect movement of the movable assembly. Such movement may be linear, rotational, or linear and rotational. An optional user configurable attachment assembly may be provided to change the angle, acceleration rate, speed, direction and timing of the movement challenges posed to the user by the device. As noted above, the devices comprise only a single platform and cannot provide independent movement under each foot or extremity.

U.S. Pat. No. 8,529,418 to Stewart provides a balance board including a single standing platform connected to a pivotball. The standing platform provides an area for subject to stand and can be moved by a set of deflector actuators. The deflector actuators can move the platform in both the lateral and vertical directions. A braking assembly is connected to the ball and the braking assembly increases or decreases rotation resistance to the ball. When resistance is increased to the ball, resistance to rotation for the platform is increased. Also as noted above, the Stewart device comprises only a single platform and cannot provide independent movement under each foot or extremity.

US Patent Publication No. 20070184953 to Luberski discloses a balance trainer comprised of several inflatable bladders under a single support platform, wherein the user shifts weight on top of the bladders in order to control movement of the platform and direct a connected cursor on a computer screen. The device is limited by a single platform design.

U.S. Pat. No. 8,246,354 to Chu et al discloses a dynamic perturbation platform comprised of side by side rotating treads or belts which can be programmed to induce differential walking speeds or sudden stops or starts for balance exercise. While the separate treads can provide differential speed movements along the axis of rotation, i.e. rearward rotation to simulate walking, they are limited to one direction of movement (rearward) and have no ability to move side to side.

SUMMARY OF THE DISCLOSURE

The present disclosure proposes a novel, portable two-axis perturbation device including two separated X-Y plane motion platforms controlled by respective motor pairs that may be independently controlled with respect to frequency, amplitude, and variation of movement patterns to create unpredictable movement patterns more closely resembling real world environmental interactions. By reproducing the amplitude, frequency, direction and variability of external stimuli that may disrupt human balance, the present device provides a novel way to train, rehabilitate, reproduce, manipulate and ultimately improve reactive balance reflexes, proprioception and kinesthetic awareness in a way that "top down" perturbation cannot.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE EXEMPLARY EMBODIMENTS

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal.

It should further be noted that the references to X and Y axes of plane movement are intended for reference only relative to the base and to motion of the relative component parts and should not be specifically construed to limit the orientation of the various component parts.

According to exemplary embodiments of the invention, a portable perturbation apparatus 10, through the ability to propagate motion in the X and Y planes independently under each extremity (upper or lower depending on application) or simultaneously through a single fixed board attachment, provides the appropriate forces, speeds and vectors to efficiency elicit several vestibular/balance/reflexive responses in a way that can be programmed, progressively manipulated and scaled for hundreds of applications in the aforementioned markets.

Figure 2:
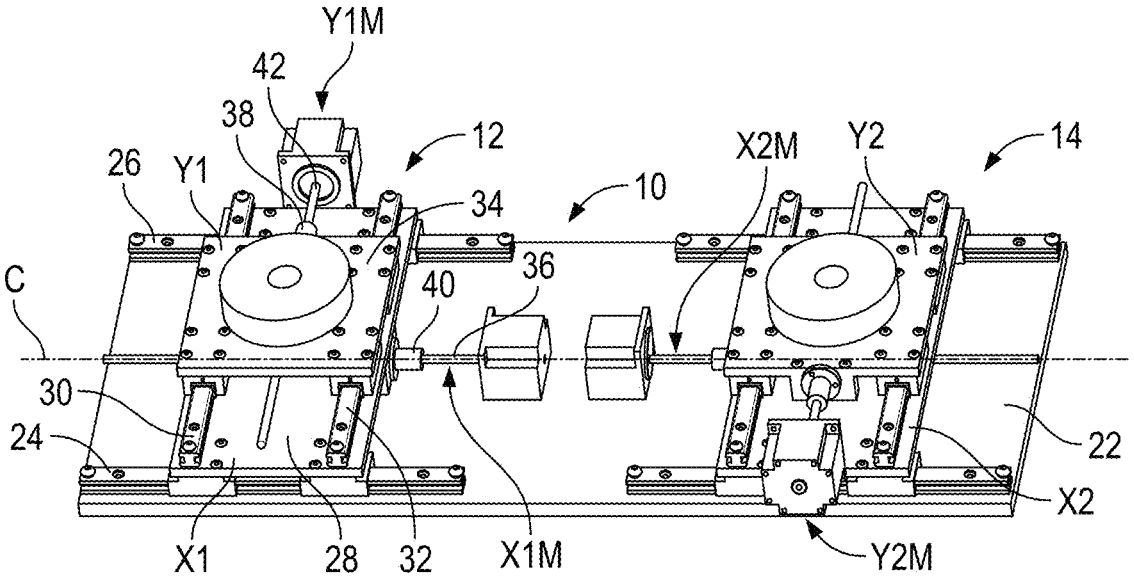
FIG. 2 is a perspective view of an exemplary embodiment of the portable dual platform perturbation device with the platforms removed to illustrate the respective motor pairs independently controlling the platforms.
Figure 3:
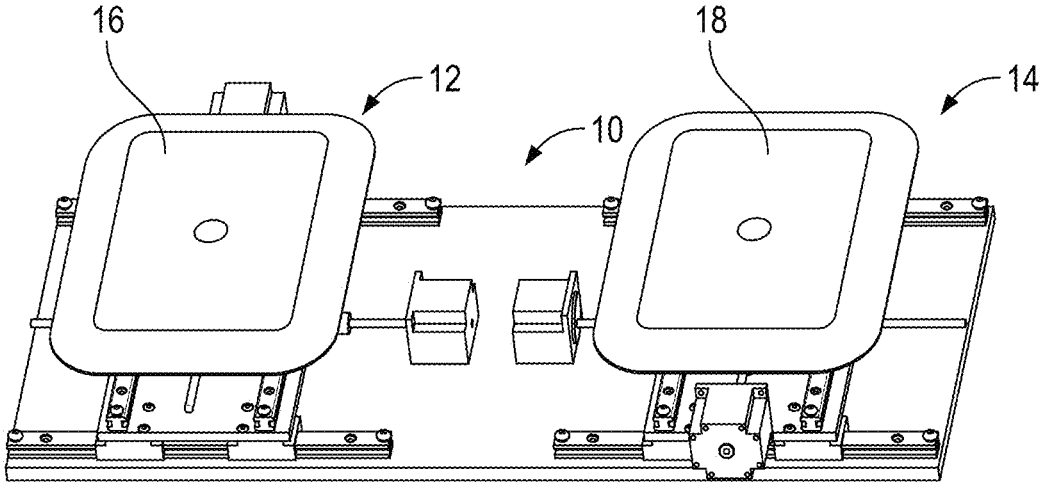
FIG. 3. is another perspective view thereof with the platforms installed for supporting a user.

Generally referring to FIGS. 2 and 3, the apparatus 10 includes two independently addressable platform assemblies 12, 14 which translate linearly in two degrees of freedom (X and Y axes). Each platform assembly 12, 14 includes a respective foot pad 16, 18 which is controlled by two independent drive train systems each controlled by a separate motor all mounted on a unitary stationary base. As will be described in more detail below, an X-axis carriage (Carriages X1/X2) is mounted on spaced slides. The X-axis carriages in turn support two spaced Y-axis carriages (Carriages Y1/Y2) on which the foot pads are carried.

FIGS. 2 and 3 illustrates the apparatus 10 with separate foot pads 16, 18 installed for independent movement. The foot pads may be installed on ball joint assemblies 20 (See FIG. 5) which may be rotated, tilted and/or pitched in various orientations and locked or may be left to float with a suitable friction lock. Other types of fixed and movable mounting configurations are also contemplated within the scope of the invention.

Figure 4:
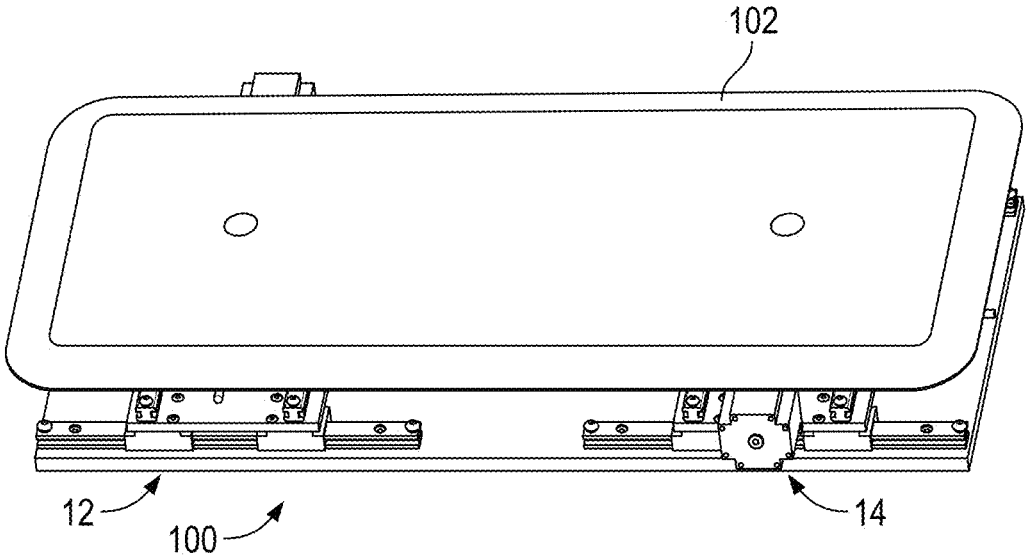
FIG. 4 is another perspective view of an alternate exemplary embodiment including a single platform installed for single platform training.

As seen in FIG. 4, an alternate apparatus 100 may also be provided with a single platform 102 (Dual Foot Platform) mounted to both Y-axis carriages and controlled for synchronized movement of the underlying mounting blocks. The single platform 102 may also include the ball joint mounts 20 which may be rotated, tilted and/or pitched in various orientations and locked or may be left to float with a suitable friction lock.

Figure 1:
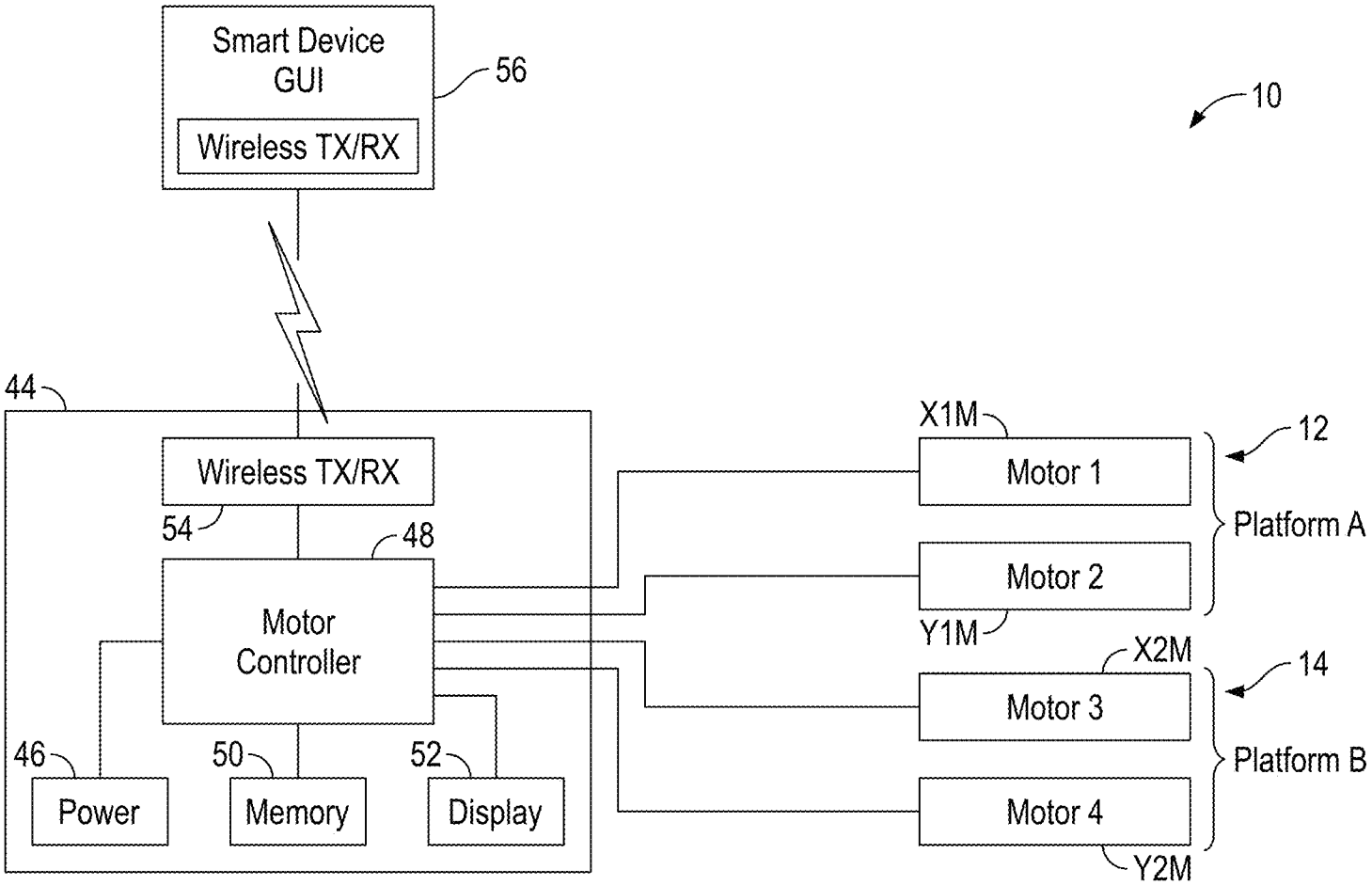
FIG. 1 is a schematic block diagram of an exemplary electronic control system of the portable dual-platform perturbation device.

More specifically, and now referring to FIGS. 1-3, a portable perturbation apparatus for proprioceptive and vestibular training and therapy is indicated at 10 and comprises, a stationary base 22, a first platform assembly mounted 12 on an upper surface of the base 22 and a second platform assembly 14 also mounted on the upper surface of the base 22. The first and second platform assemblies 12, 14 are disposed in spaced relation and aligned along a longitudinal centerline (C) of the base (See FIG. 2). As previously described, the first and second platform assemblies 12, 14 are independently movable in X-Y planar motion relative to each other and relative to the base 22 to achieve the desired perturbation movements.

Figure 5:
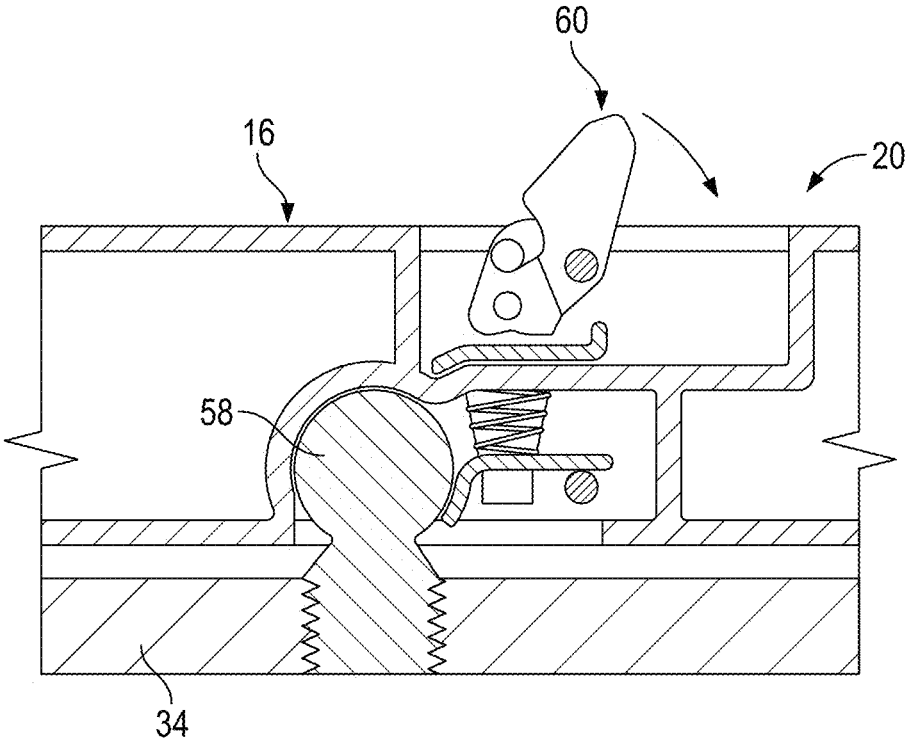
FIG. 5 is an exemplary configuration for a ball and socket joint between the foot platform(s) and the Y-axis carriages.

The first platform assembly 12 comprises an X-axis carriage (X1) mounted to the base 22, a motor and powertrain (X1M) configured to drive motion of the X-axis carriage (X1) relative to the base, a Y-axis carriage (Y1) mounted to the X-axis carriage (X1) and a motor and powertrain (Y1M) configured to drive motion of the Y-axis carriage (Y1) relative to the X-axis carriage (X1). A first foot pad 16 may be removably mounted to the Y-axis carriage (Y1) with a ball joint configuration 20 as illustrated in FIG. 5.

Similarly, the second platform assembly 14 comprises an X-axis carriage (X2) mounted to the base, a motor and powertrain (X2M) configured to drive motion of the X-axis carriage (X2) relative to the base, a Y-axis carriage (Y2) mounted to the X-axis carriage (X1), and a motor and powertrain (Y2M) configured to drive motion of the Y-axis carriage (Y2) relative to the X-axis carriage (X2). A second foot pad 18 may be removably mounted to the Y-axis carriage (Y2) with a ball joint configuration 20 as illustrated in FIG. 5.

In the exemplary embodiments, the X and Y axis carriages comprise spaced slide rail mechanisms with a platform mounted thereon. Referring to platform assembly 12, carriage X1 includes spaced slide rails 24, 26 mounted to the base 22 with a planar slide block 28 secured to the slide rails. Carriage Y1 also includes spaced slide rails 30, 32 which are secured to the top of the X slide block 28 with a slide block 34 secured to the slide rails 30, 32. This is generally configured as a 2-axis motion control system.

Motor X1M is mounted to the base 22 while motor Y1M is mounted to the X slide block 28, and drive trains each comprise a threaded drive rod 36. 38 passing through a corresponding threaded chuck 40, 42 attached to the respective slide block 28, 34 whereby rotation of the motors X1M, Y1M generates corresponding linear movements of the slide blocks 28, 24 and cooperatively movement of the platform 12 in various motion paths.

Similarly, the platform assembly 14 includes the same corresponding components and will not be called out for sake of clarity in the illustrations.

A computer implemented control system 44 may include a suitable power supply 46, motor controller(s) 48, memory 50 and a display/touch control interface 52 which may be integral to the device or the device may include a wireless transceiver 54 which may communicate wirelessly with a remote interface device 56 such as a wireless tablet or phone device programmed with a user interface.

The motor controller 48 is in independent electrical communication with each of the motors X1M, X2M, Y1M, Y2M. User programmable computer code resides in a memory 50 as part of the control system 44 and controls operation of the motor controller 48. In this regard, the motor controller 48 is programmable and operable for independent control of each of the motors to perturbate a user disposed on the first and second foot pads 16, 18.

Figure 6:
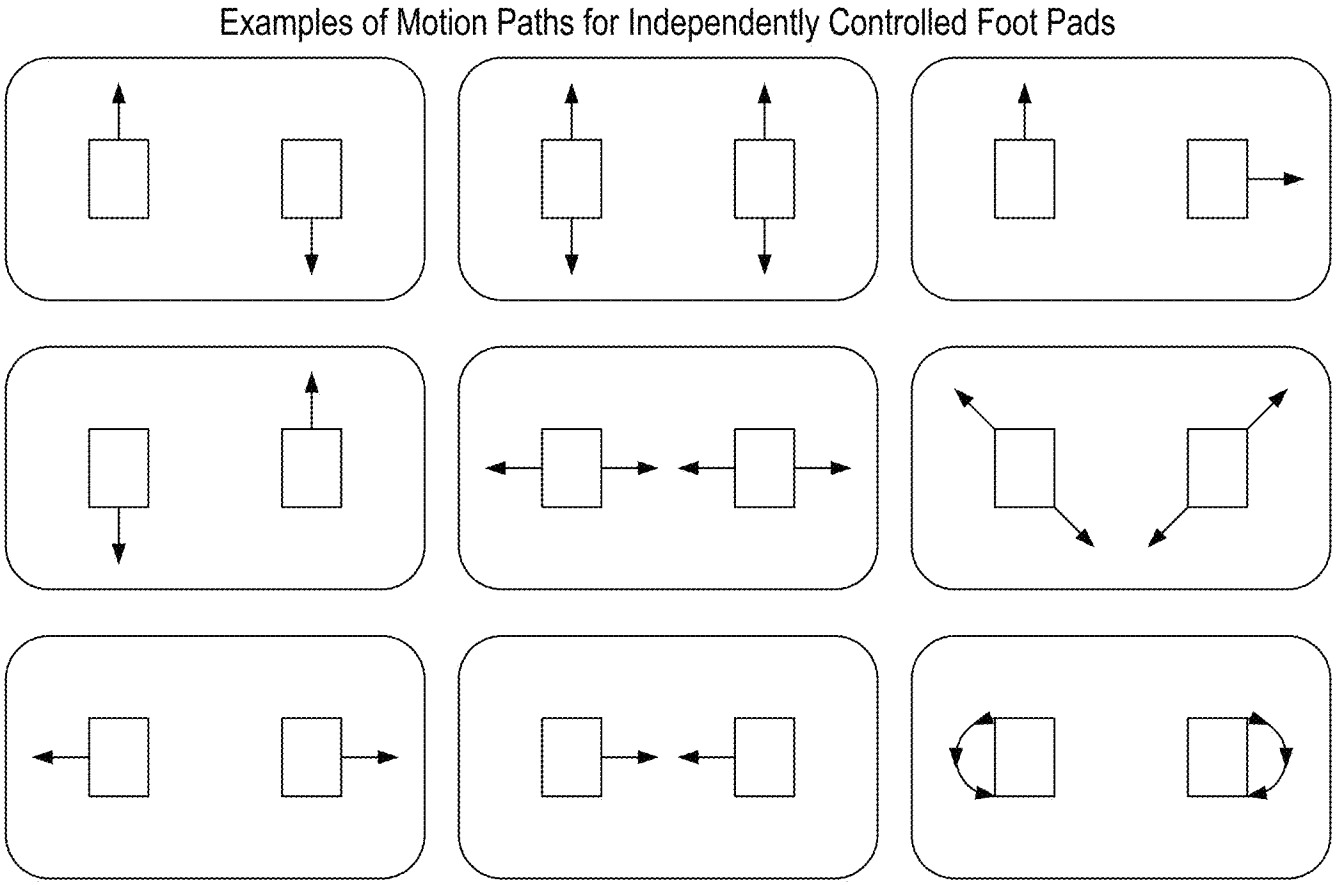
FIG. 6 illustrates different proposed motion paths for each of the independently controlled foot pads.

Referring to FIG. 6, a plurality of exemplary motion paths are illustrated. Through these various pre-programmed training or therapy routines and motions, the device is able to perturbate the a body part on the platform(s) 12, 14 with respect to gravity, ground reaction force, user weight and manipulation of the human vestibular, proprioceptive and visual cortices as a reactionary function of normal, abnormal and dysfunctional human neuroanatomy. However, the present disclosure and operation of the device should not be limited by only the described motion paths.

Referring to FIG. 5, an exemplary ball joint attachment mechanism 20 is illustrated. A ball element 58 may be secured to the Y-axis carriage block 34 and the foot pad 16 may carry a spring biased cam lock mechanism 60 which can frictionally engage the ball element 58. The cam lock mechanism 60 can be recessed within the body of the foot pad 16 and may be adjustable to provide varying levels of frictional engagement. In this regard, the ball socket 20 may provide the first and second foot pads 16, 18 with relative movement to their respective Y-axis carriage (Y1,Y2) including tilt and rotation.

Finally, referring to FIG. 4, there is illustrated an alternative embodiment of the perturbation apparatus 100 which includes a single platform 102 (Dual Foot Platform) mounted to both motion platforms 12, 14 and controlled for synchronized movement of the underlying mounting blocks. The single platform 102 may also include the ball joint mounts 20 described above which may be rotated, tilted and/or pitched in various orientations and locked or may be left to float with a suitable friction lock.

The portable apparatus 10, 100 provide perturbation from the ground or bottom up, where other devices on the market are top down, anticipatory, or user driven.

Unique features of the apparatus include but are not limited to the following.

The ability to control the foot pads separately or together with a series of pre-programmed motion paths.

The ability to create custom motion and/or randomized paths to target the device to specific patients or specific muscle groups.

The ability to vary the speed/frequency of the motion paths for a range of clinical applications.

The ability to vary the distance/amplitude of the motion paths for a range of clinical applications.

The ability to vary the acceleration/deceleration of the motion paths for a range of clinical applications.

The ability to tilt/pitch the foot platforms about the X and Y axes.

The device is light weight and may be portable, i.e. can be moved around a clinic, facility or home with ease (not a permanent fixture).

A control interface may be integral to the device, or remotely operated from a tablet or device, or both.

An additional removable single "Board" fixed to both movable pads with the ability to rotate about the center point of each pad at a fixed distance. Motion of the board can be in any combination of X and Y, with simulated rotation about the center of the base.

To date, there are over 36,000 outpatient physical therapy clinics in the United States and another 15,000 in Canada. Our portable perturbation device could revolutionize human physical rehabilitation and sports performance by providing a ubiquitous and affordable method to depart from the predictable and sub-maximal balance protocols of today. The device represents a significant evolution of rehabilitation and human performance training.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described.

What is claimed is:

1. A perturbation apparatus for proprioceptive and vestibular training and therapy comprising:

a stationary, generally planar base having a lower surface configured to be received on a supporting surface;

a first platform assembly mounted on an upper surface of the base;

a second platform assembly mounted on an upper surface of the base, the first and second platform assemblies disposed in spaced relation and aligned along a longitudinal centerline of the base, the first and second platform assemblies being independently movable only in X-Y planar motion relative to each other and only in X-Y planar motion relative to the base;

the first platform assembly comprising:

an X-axis carriage (X1) mounted directly to the upper surface of the base, a motor and powertrain (X1M) configured to drive linear motion of the X-axis carriage (X1) relative to the base, a Y-axis carriage (Y1) mounted to the X-axis carriage (X1), a motor and powertrain (Y1M) configured to drive linear motion of the Y-axis carriage (Y1) relative to the X-axis carriage (X1); and a first foot pad removably mounted to the Y-axis carriage (Y1);

the second platform assembly comprising:

an X-axis carriage (X2) mounted directly to the base, a motor and powertrain (X2M) configured to drive linear motion of the X-axis carriage (X2) relative to the base, a Y-axis carriage (Y2) mounted to the X-axis carriage (X2), a motor and powertrain (Y2M) configured to drive linear motion of the Y-axis carriage (Y2) relative to the X-axis carriage (X2); and a second foot pad removably mounted to the Y-axis carriage (Y2);

a motor controller in independent electrical communication with each of said motors X1M, X2M, YIM, Y1M; and user programmable computer code residing in a memory and in communication with said motor controller, wherein said motor controller is programmable and operable for independent control of each of said motors to perturbate a user disposed standing on said first and second foot pads.

2. The portable perturbation apparatus of claim 1 wherein the first and second foot pads are movable relative to their respective Y-axis carriage (Y1,Y2).

3. The portable perturbation apparatus of claim 2 wherein the first and second foot pads tilt relative to their respective Y-axis carriage (Y1,Y2).

4. The portable perturbation apparatus of claim 2 wherein the first and second foot pads are rotatable relative to their respective Y-axis carriage (Y1,Y2).

5. The portable perturbation apparatus of claim 2 wherein the first and second foot pads are connected to their respective Y-axis carriage (Y1,Y2) with ball and socket joints.

6. The portable perturbation apparatus of claim 1 wherein movement of the first and second foot pads is synchronized.

7. The portable perturbation apparatus of claim 1 wherein movements of the first and second foot pads are different from each other.

8. The portable perturbation apparatus of claim 1 wherein movement of the first and second foot pads is randomized.

9. The portable perturbation apparatus of claim 1 wherein the speed and/or frequency of the movements of the first and second foot pads varies.

10. The portable perturbation apparatus of claim 1 wherein the distance and/or amplitude of the movements of the first and second foot pads varies.

11. The portable perturbation apparatus of claim 1, wherein the X-axis carriage (X1) of the first platform comprises X1 slide rails mounted directly to the upper surface of the base and an X1 slide block mounted on the X1 slide rails, and wherein the Y-axis carriage (Y1) of the first platform comprises Y1 slide rails mounted directly to an upper surface of the X1 slide block, and a Y1 slide block mounted on the Y1 slide rails, and wherein the X-axis carriage (X2) of the second platform comprises X2 slide rails mounted directly to the upper surface of the base and an X2 slide block mounted on the X2 slide rails, and wherein the Y-axis carriage (Y2) of the second platform comprises Y2 slide rails mounted directly to an upper surface of the X2 slide block, and a Y2 slide block mounted on the Y2 slide rails, the configuration of the first and second platform assemblies being movable only in X-Y planar motion relative to each other and only in X-Y planar motion relative to the base.

12. A portable perturbation apparatus for proprioceptive and vestibular training and therapy comprising:

a stationary base;

a first platform assembly mounted on an upper surface of the base;

a second platform assembly mounted on an upper surface of the base, the first and second platform assemblies disposed in spaced relation and aligned along a longitudinal centerline of the base, the first and second platform assemblies being independently movable in X-Y planar motion relative to each other and relative to the base;

the first platform assembly comprising:

an X-axis carriage (X1) mounted to the base, a motor and powertrain (X1M) configured to drive motion of the X-axis carriage (X1) relative to the base, a Y-axis carriage (Y1) mounted to the X-axis carriage (X1), a motor and powertrain (Y1M) configured to drive motion of the Y-axis carriage (Y1) relative to the X-axis carriage (X1); and the second platform assembly comprising:

an X-axis carriage (X2) mounted to the base, a motor and powertrain (X2M) configured to drive motion of the X-axis carriage (X2) relative to the base, a Y-axis carriage (Y2) mounted to the X-axis carriage (X2), a motor and powertrain (Y2M) configured to drive motion of the Y-axis carriage (Y2) relative to the X-axis carriage (X2); and a dual foot pad removably mounted to the Y-axis carriage (Y1) and the Y-axis carriage (Y2);

a motor controller in independent electrical communication with each of said motors X1M, X2M, Y1M, Y2M; and user programmable computer code residing in a memory and in communication with said motor controller, wherein said motor controller is programmable and operable for independent control of each of said motors to perturbate a user disposed on said dual foot pad.

13. The portable perturbation apparatus of claim 12 wherein the dual pad is movable relative to the Y-axis carriages (Y1,Y2).

14. The portable perturbation apparatus of claim 12 wherein the dual foot pad tilts relative to Y-axis carriages (Y1,Y2).

15. The portable perturbation apparatus of claim 12 wherein movement of the dual foot pad is randomized.

16. The portable perturbation apparatus of claim 12 wherein the speed and/or frequency of the movements of the dual foot pad varies.

17. The portable perturbation apparatus of claim 12 wherein the distance and/or amplitude of the movements of the dual foot pad varies.

* * * * *